US012714228B1

(12) United States Patent
Patel

(10) Patent No.: US 12,714,228 B1
(45) Date of Patent: Aug. 25, 2026

(54) CHAIR CANOPY

(71) Applicant: Netstores USA, LLC, Jacksonville, FL (US)

(72) Inventor: Vinod Patel, Jacksonville, FL (US)

(73) Assignee: Netstores USA, LLC, Jacksoneville, FL (US)

( * ) Notice: Subject to any disclaimer, the term of this patent is extended or adjusted under 35 U.S.C. 154(b) by 0 days.

(21) Appl. No.: 19/408,492

(22) Filed: Dec. 4, 2025

(51) Int. Cl.
*A47C 7/66* (2006.01)

(52) U.S. Cl.
CPC ..... *A47C 7/66* (2013.01)

(58) Field of Classification Search
CPC ..... A47C 7/66
See application file for complete search history.

(56) References Cited

U.S. PATENT DOCUMENTS

| | | | | |
|---|---|---|---|---|
| 3,243,230 | A | 3/1966 | Otto | |
| 4,687,249 | A | 8/1987 | Mills | |
| 4,809,724 | A | 3/1989 | Fuser | |
| 4,858,990 | A | 8/1989 | Combs-Rose | |
| 5,000,210 | A | 3/1991 | Worthington, Jr. | |
| 5,013,085 | A | 5/1991 | Graig | |
| 5,096,257 | A | 3/1992 | Clark | |
| 5,921,258 | A * | 7/1999 | Francois | A61G 5/1054 135/117 |
| 5,967,601 | A | 10/1999 | Gillins | |
| 6,101,678 | A | 8/2000 | Malloy | |
| 6,405,742 | B1 | 6/2002 | Driscoll | |
| 6,520,574 | B1 | 2/2003 | Huang | |
| 7,243,990 | B1 | 7/2007 | Wahl | |
| 7,431,389 | B2 | 10/2008 | Reeb | |
| 7,566,095 | B2 | 7/2009 | Reeb | |
| 7,585,020 | B1 | 9/2009 | Wahl, Jr. | |
| 7,753,063 | B1 | 7/2010 | Laws | |
| 8,146,879 | B2 | 4/2012 | Liao | |
| 8,186,755 | B2 | 5/2012 | Lovley | |
| 8,292,362 | B2 | 10/2012 | Reeb | |
| 8,776,810 | B2 | 7/2014 | Lah | |
| D712,730 | S | 9/2014 | Gridley | |
| 9,049,938 | B2 | 6/2015 | Reeb | |

(Continued)

FOREIGN PATENT DOCUMENTS

GB 2409234 A * 6/2005 ..... A45B 23/00

*Primary Examiner* — David R Dunn
*Assistant Examiner* — Tania Abraham
(74) *Attorney, Agent, or Firm* — Lewellyn Law, PLLC; Stephen Lewellyn

(57) ABSTRACT

A detachable and adjustable chair canopy is configured to provide shade for a seated user while allowing a chair to be used in both upright and reclined positions. The canopy includes a first frame attachable to the chair back by tool-less clamp assemblies and a second frame supporting a canopy panel pivotally connected to the first frame. Each clamp assembly includes a resilient C-shaped clamp and a locking hub that permits rotation of the canopy relative to the chair and selective locking at a desired orientation. A pair of pivot couplers are slidingly mounted on the first frame and pivotally connected to struts extending to the second frame, each pivot coupler having a hand-operated toggle lever for selective locking. The canopy can be folded to a compact stowed position behind the chair back without removal and reoriented to maintain shading coverage across multiple reclining positions of the chair.

13 Claims, 11 Drawing Sheets

(56) References Cited

U.S. PATENT DOCUMENTS

| | | | | |
|---|---|---|---|---|
| 9,220,347 | B2 * | 12/2015 | Lovley, II | A47C 7/66 |
| 9,451,830 | B1 | 9/2016 | Buzzella | |
| 9,797,157 | B2 * | 10/2017 | Lovley, II | E04H 15/00 |
| 10,040,501 | B2 | 8/2018 | Haines | |
| D932,580 | S | 10/2021 | Lovley | |
| 11,185,167 | B1 | 11/2021 | Holland | |
| 11,717,091 | B2 * | 8/2023 | Silinski | A47C 4/286 297/184.15 |
| 2002/0112752 | A1 * | 8/2002 | Blakney | E04H 15/003 135/96 |
| 2012/0211038 | A1 * | 8/2012 | Pirshafiey | A47C 7/72 135/96 |
| 2016/0010358 | A1 * | 1/2016 | Ashley | A47C 1/143 135/96 |
| 2022/0136278 | A1 * | 5/2022 | Seelaus | A45B 11/00 135/121 |

* cited by examiner

CHAIR CANOPY

FIELD OF THE INVENTION

The present invention relates generally to shade structures for portable seating, and more particularly to a detachable and adjustable canopy system configured for attachment to a chair, such as a folding or beach chair, to provide variable sun protection and comfort for a seated user.

BACKGROUND OF THE INVENTION

Portable chairs such as beach chairs, lawn chairs, and folding recliners are commonly equipped with optional shade canopies to protect users from direct sunlight. Existing canopy systems, however, often suffer from limited adjustability and poor compatibility with reclining chair designs. Many known canopies are fixed in orientation or depend on simple hinge or ratchet mechanisms that restrict movement to a narrow range of angles. When the chair backrest is reclined, these canopies typically lose effectiveness, either blocking the user's forward view or failing to provide adequate overhead shade.

In addition, conventional canopies are frequently integrated into the chair frame or require specialized mounting hardware, making them cumbersome to install, remove, or adjust. Such systems cannot generally remain functional across multiple recline positions of the chair without manual repositioning or reassembly.

Accordingly, there is a need for a chair canopy that maintains effective sun shading across varying chair-back recline positions, that is easily attachable and detachable without tools, and that allows continuous and customizable angular adjustment without the limitations of ratchet or detent systems.

SUMMARY OF THE INVENTION

The present invention provides a detachable and adjustable chair canopy configured to attach to the back of a chair, such as a folding or reclining beach chair, to provide sun protection and comfort for a seated user. The canopy includes a pair of frame members that support a flexible canopy panel and are configured to move relative to one another to allow angular adjustment of the canopy.

In one embodiment, the canopy includes a first frame that serves as a mounting frame and a second frame that supports the canopy panel. The first frame is attached to the chair by a pair of clamp assemblies that removably secure the canopy to upright posts of the chair back. The second frame is pivotally connected to the first frame to allow adjustment of the canopy panel about a transverse axis.

Each clamp assembly may include a resilient C-shaped clamp body configured to flex for attachment to or removal from a chair post without tools. The clamp body may include a locking hub that allows the first frame to rotate relative to the chair back and to be selectively locked in place. The locking hub may incorporate spring-biased hub portions, intermeshing contact surfaces, and a manually operable cam toggle lever for varying rotational friction and securing the canopy at a desired angle.

The canopy further includes a pair of pivot couplers that slidingly engage the first frame and pivotally connect to struts extending to the second frame. Each pivot coupler includes a hand-operated toggle lever that tightens or releases the coupler around the first frame, allowing the canopy angle to be adjusted smoothly and locked in place.

The couplers may further include serrations that engage matching serrations on the coupler body to retain the lever in a locked position.

The clamp assemblies may be vertically repositioned along the chair back to change the height of the canopy, while the combination of the clamp assemblies and pivot couplers allows the canopy to rotate through a continuous range of motion, including forward, upward, and rearward orientations. The canopy can be folded to a compact stowed position behind the chair back without detachment from the chair, permitting easy transport and storage. When used with a backpack-style folding chair, the stowed configuration allows the chair and canopy to be carried together as a single integrated unit.

In an embodiment, the chair canopy includes a first frame configured for attachment to a chair back and a second frame supporting a canopy panel and pivotally connected to the first frame. A pair of clamp assemblies removably secure the canopy to the chair back, and each clamp assembly is selectively lockable to fix the rotational position of the first frame relative to the chair. A pair of pivot couplers are slidingly attached to the first frame and pivotally connected to respective struts extending to the second frame, each pivot coupler being selectively lockable to fix the angular position of the second frame relative to the first frame.

In another aspect, each clamp assembly may include a C-shaped clamp formed of a resilient material that flexes to attach to or release from the chair post without the use of tools while maintaining a frictional grip when engaged. The clamp may further be configured to release automatically when subjected to an excessive upward or lateral force, thereby preventing damage to the canopy or the chair.

In a further embodiment, each clamp assembly may include a locking hub connecting the clamp body to the first frame. The locking hub may permit rotation of the canopy relative to the chair back through approximately 360 degrees and may include a first hub portion connected to the clamp body, a second hub portion connected to the first frame, and a hand-operable cam lever configured to adjust spring tension between the hub portions. The hub portions may include intermeshing recesses and raised surfaces arranged circumferentially around a central cylindrical interface to maintain alignment and distribute load evenly.

In another embodiment, the locking hub may include a coil spring and washer arrangement configured to bias the hub portions together and provide adjustable frictional resistance during rotation, and may include enclosed surfaces designed to minimize the ingress of sand or debris to maintain smooth operation in outdoor conditions.

In another aspect, each pivot coupler may include a clamp body defining a passage through which a leg of the first frame extends, the clamp body having opposed legs joined by a cross member. Each pivot coupler may further include a manually operable toggle lever mounted by a pintle and configured to draw the opposed legs together when locked and release them when unlocked. The toggle lever may include serrations that engage corresponding serrations on the body to retain the lever in the locked position.

In another embodiment, a strut may be pivotally connected to the coupler body opposite the toggle lever, interconnecting the first and second frames and allowing the second frame to move relative to the first frame during canopy adjustment.

Additional aspects of the invention include the ability to vertically reposition the clamp assemblies along the chair back to vary canopy height; the capability of the canopy to rotate continuously in forward, upward, and rearward orientations; and the ability of the canopy to fold into a compact stowed position behind the chair back without removal. In certain embodiments, the chair may be a backpack-style folding chair, allowing the canopy and chair to be carried together as a single integrated unit.

The chair canopy thus provides a structure combining rotational and angular adjustability, variable frictional control, and secure locking functionality. The canopy is lightweight, durable, and configured to maintain shading coverage across multiple reclining positions of the chair back. The tool-less design allows quick attachment, adjustment, and removal, offering a practical and user-friendly shading solution that overcomes the limitations of prior fixed or integrated canopies.

Numerous additional objects, features, and advantages of the present invention will be readily apparent to those of ordinary skill in the art upon a reading of the following detailed description of presently preferred, but nonetheless illustrative, embodiments of the present invention when taken in conjunction with the accompanying drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception upon which this disclosure is based may readily be utilized as a basis for the designing of other structures, methods, and systems for carrying out the several purposes of the present invention.

For a better understanding of the invention, its operating advantages and the specific objects attained by its uses, reference should be made to the accompanying drawings and descriptive matter in which there are illustrated embodiments of the invention.

BRIEF DESCRIPTION OF THE DRAWINGS

The accompanying drawings are provided by way of example to further illustrate the invention and to facilitate an understanding of various exemplary embodiments. No attempt is made to show structural details of the embodiments in greater detail than is necessary for a fundamental understanding of the invention. The description, when taken together with the drawings, will enable those skilled in the art to make and use the invention and to recognize various alternative and equivalent constructions. Identical reference numerals do not necessarily indicate identical structures; rather, the same reference numeral may be used to denote a feature that is functionally similar or serves a similar purpose. In the drawings.

DETAILED DESCRIPTION

Figure 1:
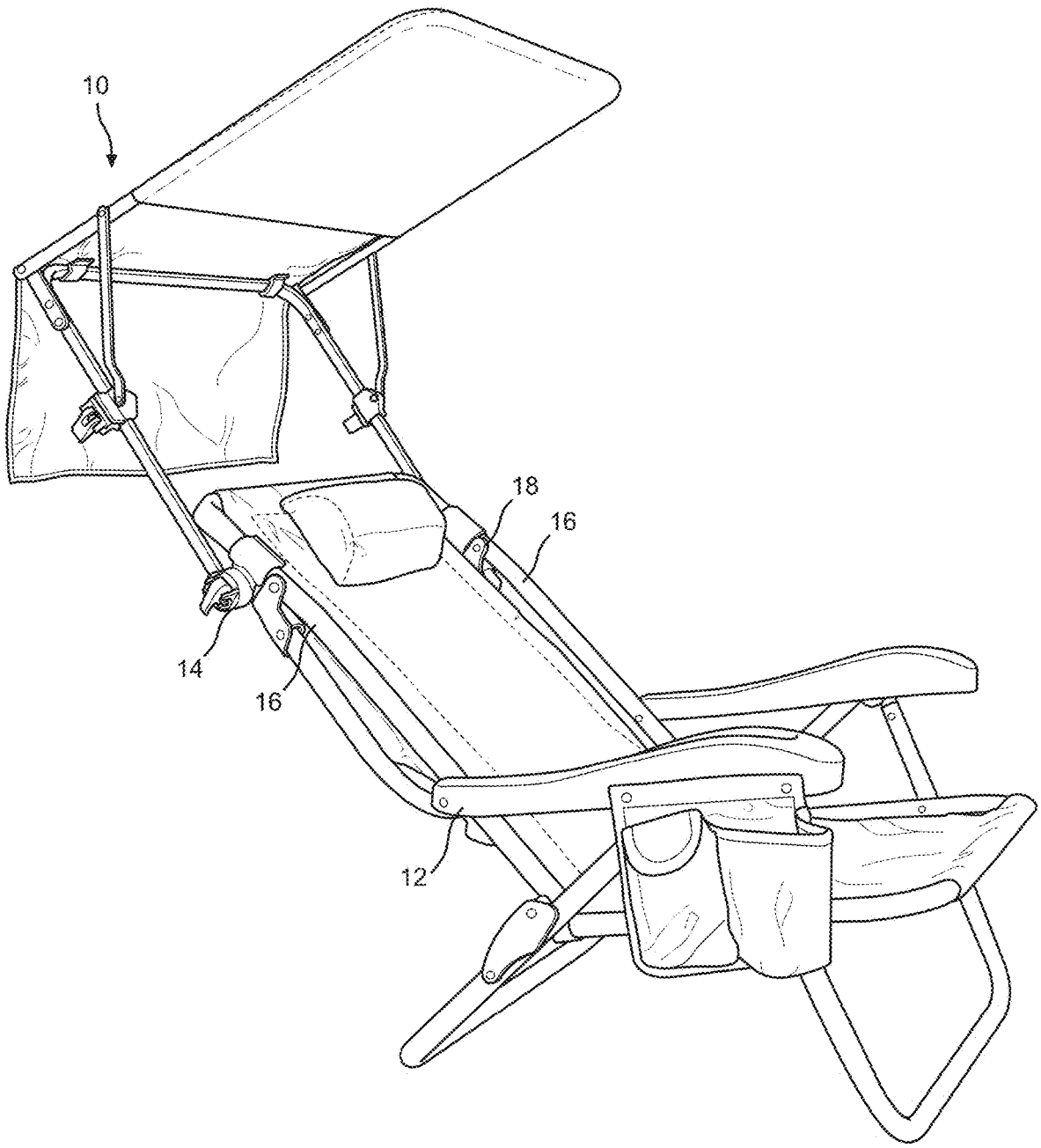
FIG. 1 is a perspective view of a chair canopy shown attached to a folding beach chair in an operative shading position.

The following description is provided to enable those skilled in the art to make and use the invention and sets forth the best modes contemplated by the inventor for carrying out the invention. It should be understood that various modifications, equivalents, and alternatives may be employed without departing from the scope of the invention as defined by the appended claims. The elements and features described in connection with one embodiment may be combined or interchanged with those of other embodiments in whole or in part, as will be apparent to those skilled in the art.

Like reference numerals designate corresponding parts throughout the several views. Directional terms such as "upper," "lower," "front," "rear," "inner," and "outer" are used in this description for clarity of explanation with reference to the orientations illustrated in the drawings and are not intended to be limiting.

As used herein, the terms "a," "an," and "the" are intended to mean "one or more" unless explicitly stated otherwise. The terms "comprising," "including," and "having" are intended to be inclusive and mean that additional elements, features, or steps may be present, unless otherwise stated.

Referring to FIG. 1, a chair canopy 10 is shown attached to a folding beach chair 12. The canopy 10 provides adjustable shade and sun protection for a person seated in the chair 12 while allowing the chair to be used in both upright and fully reclined positions. The canopy 10 is removably attached to the chair 12 and may be positioned or adjusted without tools.

The canopy 10 includes a frame construction that allows the canopy to be adjusted about two independent axes, enabling a wide range of shading orientations. The canopy 10 is further equipped with clamp assemblies 14 (only one visible) that removably secure the canopy 10 to the upright posts 16 of the chair back 18, allowing quick attachment and detachment without permanent modification to the chair 12.

The canopy 10 is designed to maintain effective shading throughout the full range of motion of the chair back, including when the chair is reclined. It can be rotated or folded between a deployed shading position, as shown, and a compact stowed position located generally behind the chair back. This configuration enables the user to quickly store the canopy 10 without detaching it from the chair 12, preserving portability and ease of use.

The canopy 10 thus provides a lightweight, detachable shade system that overcomes the limitations of fixed or integrated chair canopies by remaining functional across multiple recline positions and by permitting quick removal or stowage when not in use.

Figure 2:
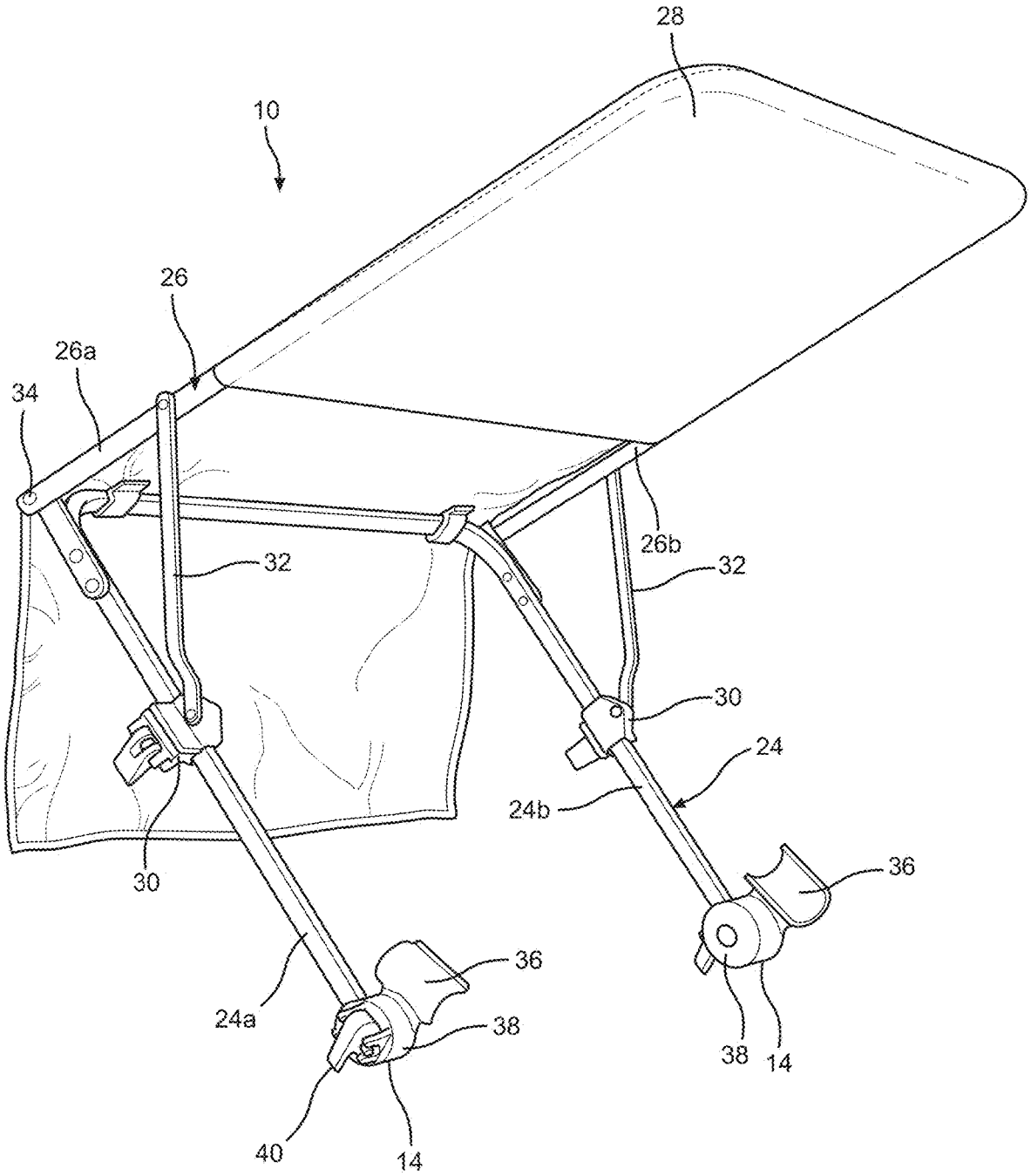
FIG. 2 is a perspective view of the canopy of FIG. 1 from one side illustrating the relative arrangement of the first and second frames, struts, and pivot couplers.
Figure 3:
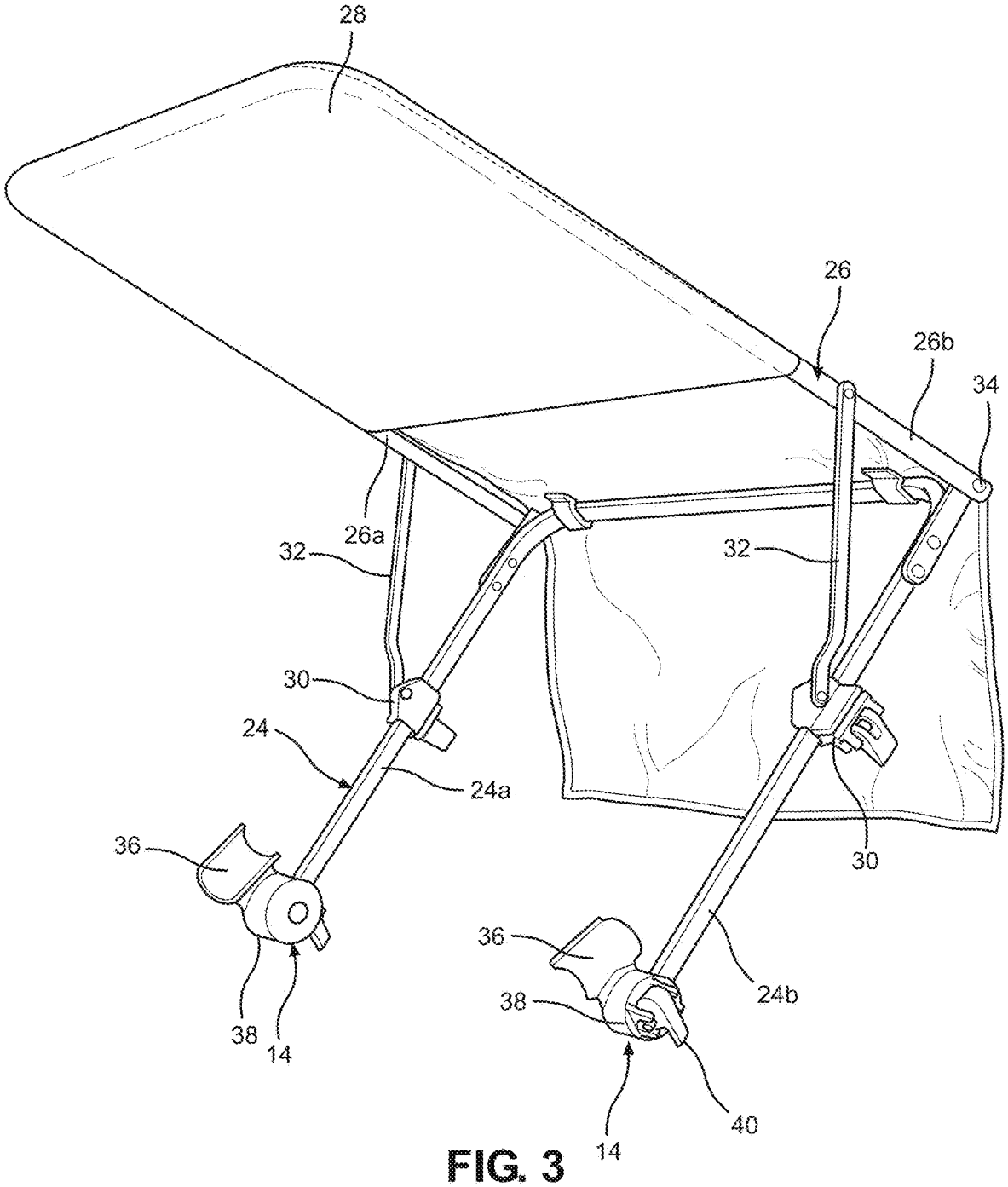
FIG. 3 is a perspective view of the canopy from the side opposite that shown in FIG. 2.

Referring to FIGS. 2 and 3, the chair canopy 10 includes a first frame 24 and a second frame 26, each of which may be generally U-shaped or formed in another configuration suitable for supporting a canopy panel 28. The frames 24 and 26 are constructed of rigid tubing or rod material, which may be metal, plastic, or another lightweight structural material capable of supporting the canopy 10 while maintaining both stability and portability.

The first frame 24 serves as a mounting frame and includes a pair of legs 24*a* and 24*b* extending downwardly from an upper cross-member. The first frame 24 is configured for attachment to the chair back 18 by way of the clamp assemblies 14. The second frame 26 provides structural support for the canopy panel 28 and includes a pair of legs 26*a* and 26*b* extending from its own cross-member. The canopy panel 28 may be formed of a flexible fabric, mesh, or sheet material stretched across the second frame 26 to provide a shaded area for the seated user.

The first frame 24 and second frame 26 are pivotally connected to one another by hinge connections 34 located on opposite sides of the canopy 10, adjacent the ends of the cross-member of the first frame 24 and the lower ends of the legs 26*a* and 26*b* of the second frame 26. This pivotal connection allows the second frame 26 to rotate relative to the first frame 24 about a common transverse axis.

The canopy 10 further includes pivot couplers 30 and corresponding struts 32. Each pivot coupler 30 is slidingly attached to a respective leg 24*a* or 24*b* of the first frame 24 and is configured to move along the length of that leg as the second frame 26 is adjusted relative to the first frame. A strut 32 extends between each pivot coupler 30 and the corresponding leg 26*a* or 26*b* of the second frame 26. The strut 32 is pivotally connected at one end to the pivot coupler 30 and at the opposite end to the respective leg of the second frame 26.

The combined action of the struts 32 and pivot couplers 30 allows the second frame 26 to rotate relative to the first frame 24 while maintaining controlled support and stability of the overall structure. As the canopy 10 is adjusted between shading and stowed positions, each pivot coupler 30 slides along its corresponding leg of the first frame 24, and the struts 32 pivot to accommodate the change in geometry. This arrangement ensures smooth, synchronized movement between the frames and reinforces the canopy 10 against torsional or lateral forces during use.

Each pivot coupler 30 includes a tool-less clamping mechanism that operates to selectively lock the sliding position of the coupler along the corresponding leg 24*a* or 24*b* of the first frame 24. By tightening or releasing this clamp, the user can fix or free the movement of the pivot coupler 30 relative to the first frame 24. When the pivot couplers 30 are locked in place, the sliding motion of the couplers is restricted, thereby holding the struts 32 in a fixed position and locking the rotational position of the second frame 26 relative to the first frame 24. This clamp structure, which enables quick and secure adjustment without the use of tools, is described in more detail herein.

Each clamp assembly 14 includes a generally C-shaped clamp 36 formed of a resilient material that allows the clamp 36 to flex slightly and securely engage a respective post 16 of the chair back 18. The resilient nature of the clamp 36 enables it to be attached to or removed from the chair post 16 without the use of tools, while maintaining a firm, frictional grip when in place. The C-shaped clamp 36 is further configured to release from the chair post 16 when subjected to an excessive upward or lateral force, such as that produced by a sudden wind gust, thereby allowing the canopy 10 to detach from the chair 12 and preventing damage to either the canopy 10 or the chair 12.

Each clamp assembly 14 further includes a locking hub 38 that connects the clamp 36 to a corresponding leg 24*a* or 24*b* of the first frame 24. The locking hub 38 permits the respective leg of the first frame 24 to rotate approximately 360 degrees relative to the C-shaped clamp 36, and therefore relative to the chair post 16 when the canopy 10 is mounted to the chair 12. A manual locking mechanism 40 is operatively associated with the locking hub 38 and can be selectively tightened or released by the user. When tightened, the manual locking mechanism 40 restricts rotation of the first frame 24 relative to the clamp 36, thereby fixing the angular position of the canopy 10. When loosened, the canopy 10 may be freely rotated to a new orientation.

This arrangement allows the user to quickly attach, adjust, or detach the canopy 10 without the use of tools, and provides both safety and convenience during outdoor use. The structure and operation of the clamp assemblies 14, including the locking hub 38 and manual locking mechanism 40, are described in further detail herein with reference to other figures.

Figure 4:
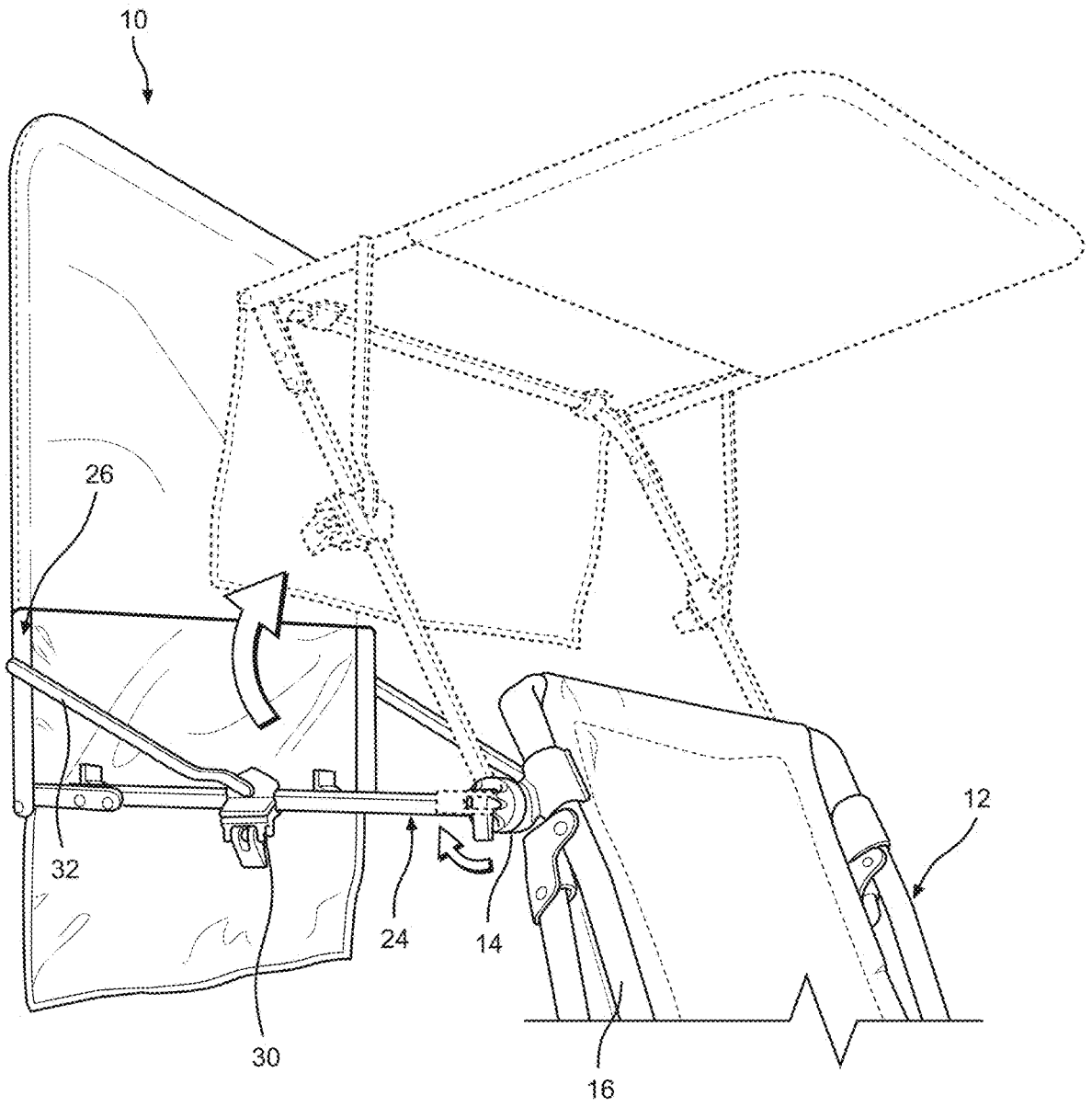
FIG. 4 is a perspective view of the canopy attached to the chair, with the canopy shown in two alternate rotational positions, one in broken line.

Referring now to FIG. 4, the canopy 10 is illustrated in two alternate rotational positions relative to the chair 12, one shown in solid line and another in broken line. These positions represent examples of the various orientations that can be achieved by the canopy 10 through adjustment of the clamp assemblies 14 and the frame construction. The first frame 24 may be rotated relative to the chair back 18 by means of the locking hubs 38, allowing the canopy 10 to be positioned to provide shade or to align with the user's preferred viewing angle.

As shown, the canopy 10 can be positioned in an active shading configuration or rotated rearward toward the chair back 18 to assume a more compact or partially stowed position. The frictional engagement of the locking hubs 38, together with the manual locking mechanism 40, enables the canopy 10 to be maintained securely in any selected position without unintended movement.

Figure 5:
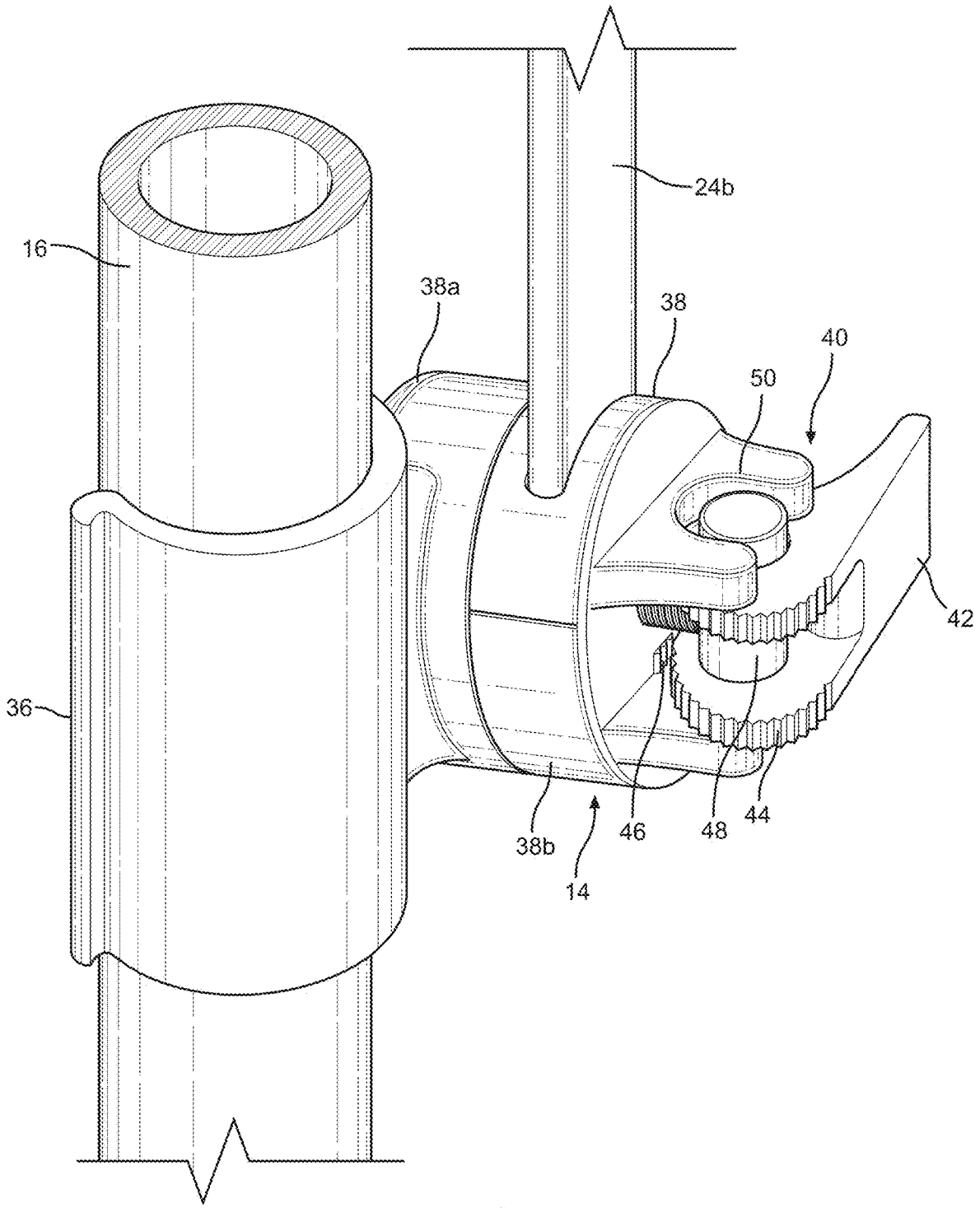
FIGS. 5 and 6 are perspective views of one of the clamp assemblies, FIG. 5 showing the clamp assembly attached to a post of the chair back, and FIG. 6 showing the clamp assembly removed from the chair.
Figure 6:
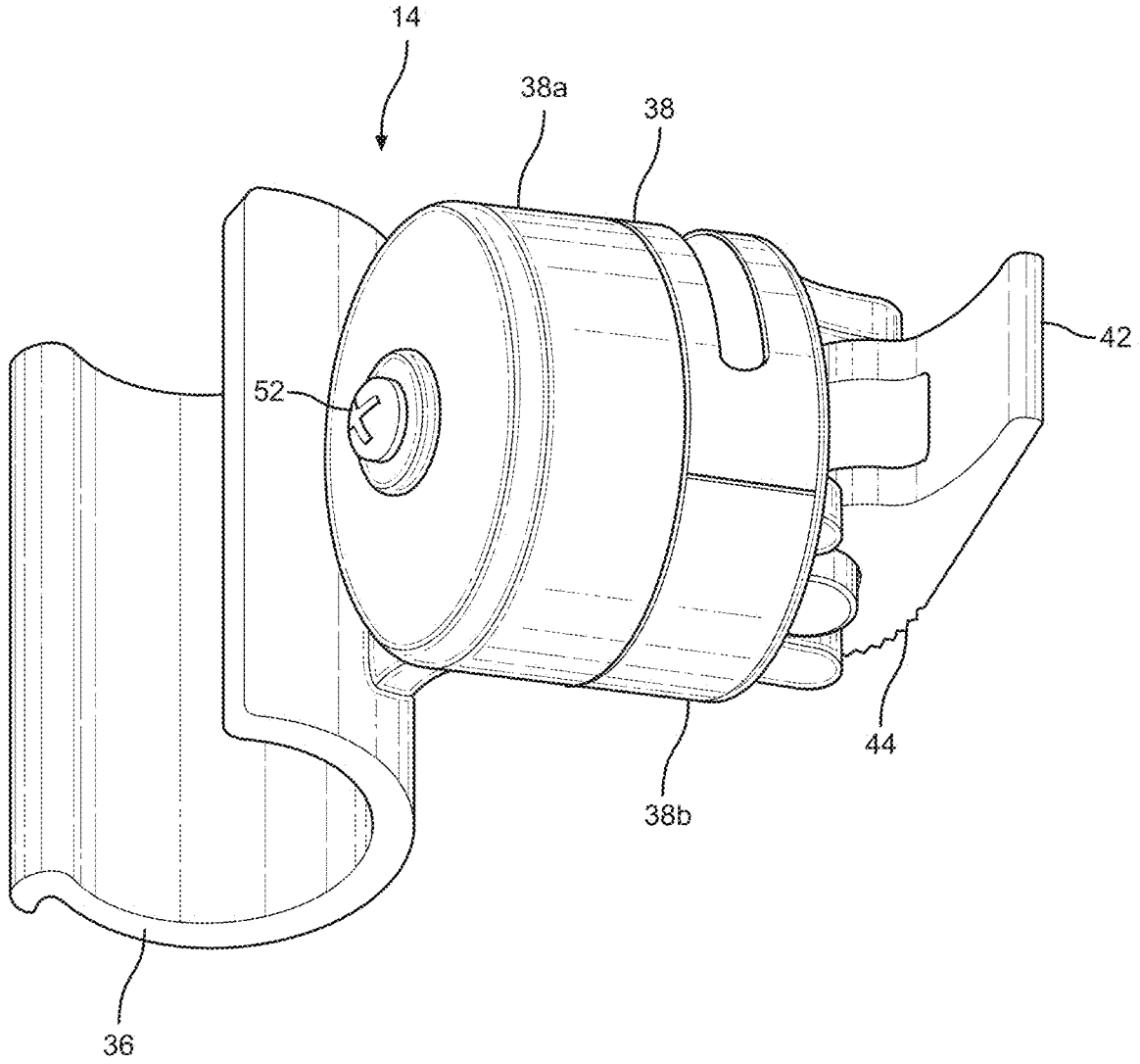

Referring to FIGS. 5 and 6, each clamp assembly 14 provides the primary attachment between the canopy 10 and the chair 12. Each clamp assembly 14 includes a generally C-shaped clamp 36 configured to engage a respective post 16 of the chair back, and a locking hub 38 that connects the clamp 36 to a corresponding leg 24*a* or 24*b* of the first frame 24. The C-shaped clamp 36 defines an open channel sized to receive the chair post 16 and is formed of a resilient material that allows the clamp to flex slightly for attachment and removal without the use of tools, while maintaining a secure frictional grip when engaged. The clamp assemblies 14 may be positioned at various heights along the chair post 16 to adjust the vertical location of the canopy 10 relative to the chair back 18. The resilient nature of the C-shaped clamp 36 also allows the canopy 10 to detach from the chair when subjected to an excessive upward or lateral force, such as a sudden wind gust, thereby preventing damage to either the canopy 10 or the chair.

The locking hub 38 is generally cylindrical in shape and includes a first hub half 38*a* and a second hub half 38*b*. The first hub half 38*a* is connected to the C-shaped clamp 36, while the second hub half 38*b* is connected to a corresponding leg 24*a* or 24*b* of the first frame 24. The two hub halves 38*a* and 38*b* are rotatably coupled to one another and are capable of rotating through approximately 360 degrees to permit full angular adjustment of the canopy 10 relative to the chair or C-shaped clamp 36. The locking hub 38 is configured to minimize the inclusion of sand, dirt, and other debris, thereby maintaining smooth rotational movement and reducing wear during outdoor use.

The hub halves 38*a* and 38*b* are maintained under spring tension that provides a controlled frictional contact between the two hub halves. This spring tension allows the canopy 10 to hold its position through frictional resistance when the toggle is in an intermediate position, and can be selectively adjusted by the manual locking mechanism 40. When the cam toggle lever 42 is moved to a fully released position, the hub halves 38*a* and 38*b* rotate freely relative to one another. When moved to a fully locked position, the toggle lever 42 compresses the hub halves together, restricting movement entirely. Between these two extremes, the toggle lever 42 can be adjusted to create variable frictional resistance, allowing smooth but controlled motion of the canopy 10.

The cam toggle lever 42 can be operated by a user's thumb or fingers and may include serrations or teeth 44 that engage corresponding serrations or teeth 46 formed on the hub 38 to enhance frictional engagement and positional stability when locked. The toggle lever 42 is rotatably mounted to the hub half 38*b* by a pintle 48, the opposite ends of which are supported within saddles 50 formed into the hub 38. This configuration provides a durable, tool-less locking interface that resists contamination, allows fine adjustment of frictional resistance, and enables quick and secure repositioning of the canopy 10 relative to the chair.

Figure 7:
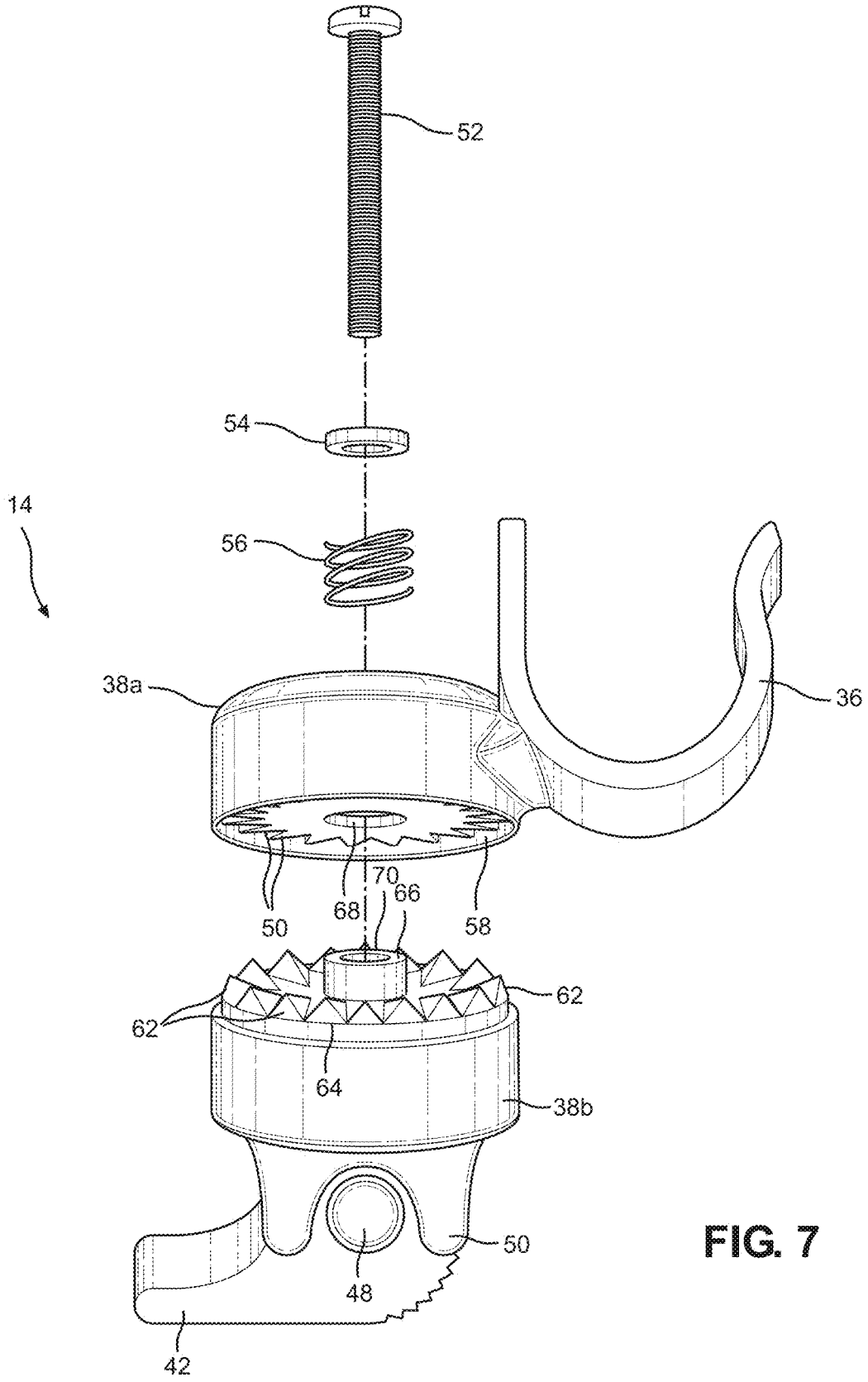
FIG. 7 is an exploded perspective view of the clamp assembly showing the C-shaped clamp, hub components, toggle lever, and associated hardware.

Referring to FIG. 7, an exploded perspective view of the clamp assembly 14 is shown. The clamp assembly 14 includes the C-shaped clamp 36, the locking hub 38 composed of a first hub half 38*a* and a second hub half 38*b*, and the manual locking mechanism 40 including the cam toggle lever 42. The hub halves 38*a* and 38*b* are coupled together by a threaded bolt 52 that extends through corresponding openings formed in each hub half and is threaded into the pintle 48.

A washer 54 and coil spring 56 are disposed about the bolt 52 between the bolt head and one of the hub halves to provide adjustable spring tension between the hub halves. The coil spring 56 biases the hub halves 38*a* and 38*b* toward one another to produce a controlled frictional contact, maintaining the canopy 10 in a selected position during use.

The first hub half 38*a* has an interior surface defining a plurality of recesses 58 arranged circumferentially around a central cylindrical portion 60. The second hub half 38*b* has a plurality of raised surfaces 62, representatively of shortened pyramidal shape, arranged around a corresponding central cylindrical structure 64. The raised surfaces 62 of the second hub half 38*b* are received within the corresponding recesses 58 of the first hub half 38*a* to provide a stable, frictional interface between the two hub halves.

An interior hub 66 extends axially from the central cylindrical structure 64 of the second hub half 38*b* and is received within a corresponding recess 68 formed in the first hub half 38*a*. The interior hub 66 defines a passage 70 through which the bolt 52 extends to be threaded into the pintle 48. When assembled, the bolt 52, washer 54, and coil spring 56 secure the hub halves together under adjustable spring compression, allowing smooth relative rotation when the toggle lever 42 is in the unlocked position and firm resistance or full locking when the toggle lever 42 is actuated.

When assembled, the internal configuration of the locking hub 38 provides a durable, debris-resistant, and friction-controlled interface between the hub halves 38*a* and 38*b*. The intermeshing recesses 58 and raised surfaces 62 maintain concentric alignment and distribute rotational loads evenly across the hub interface, while the enclosed interior hub 66 shields the internal components from sand, dirt, and other contaminants that may be encountered in outdoor environments. The coil spring 56 provides constant tension to generate adjustable friction between the hub halves, which can be increased, decreased, or fully released through operation of the cam toggle lever 42. This construction allows the locking hub 38 to transition smoothly between freely rotating, resistance-based, and fully locked conditions. The overall configuration of the clamp assembly 14 thereby combines tool-less installation, precise adjustment, and environmental durability to support reliable use of the canopy 10 in varied outdoor conditions.

Figure 8:
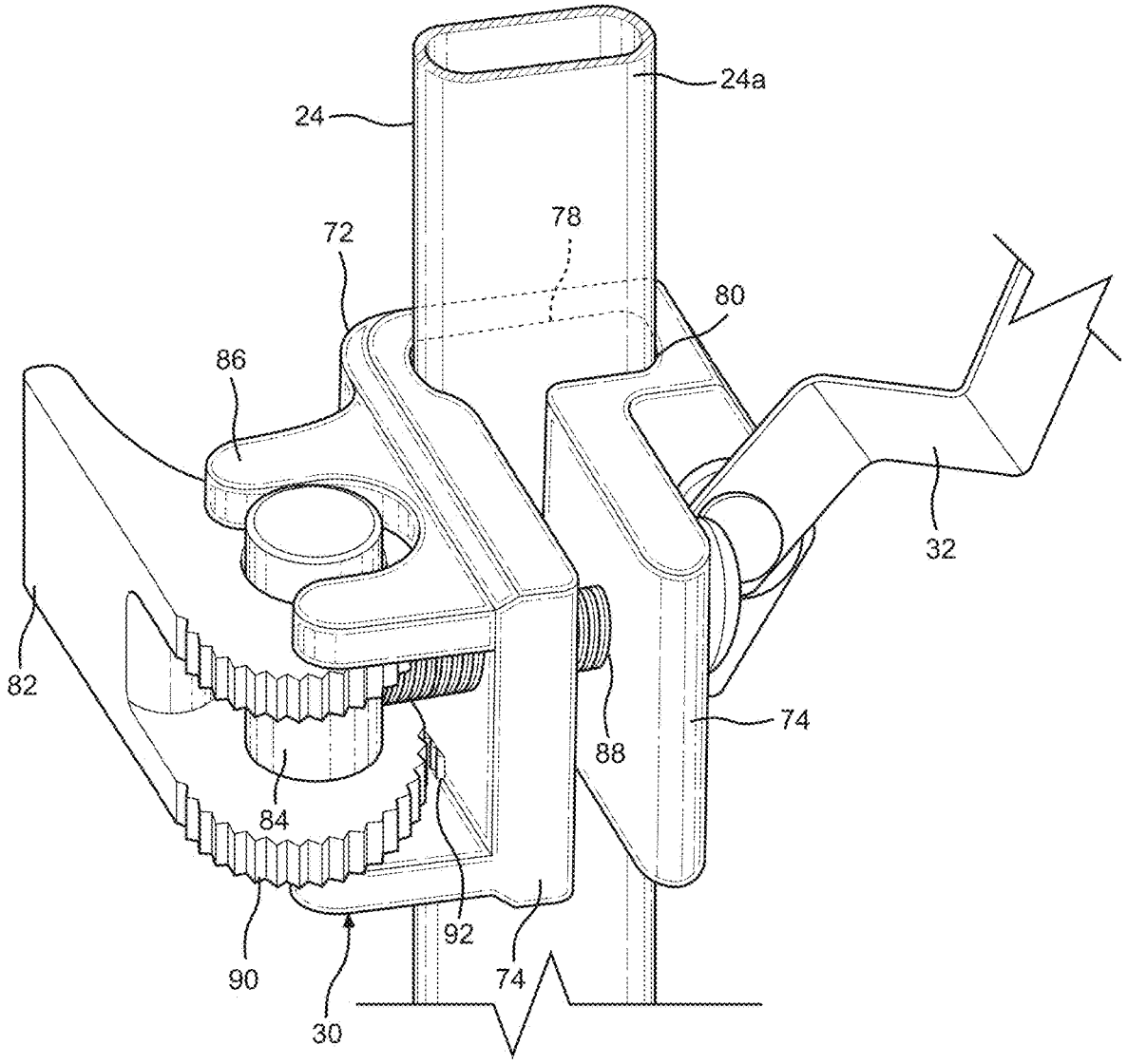
FIGS. 8 and 9 are perspective views of one of the pivot couplers, FIG. 8 showing the coupler attached to a leg of the first frame, and FIG. 9 showing the coupler removed from the frame.
Figure 9:
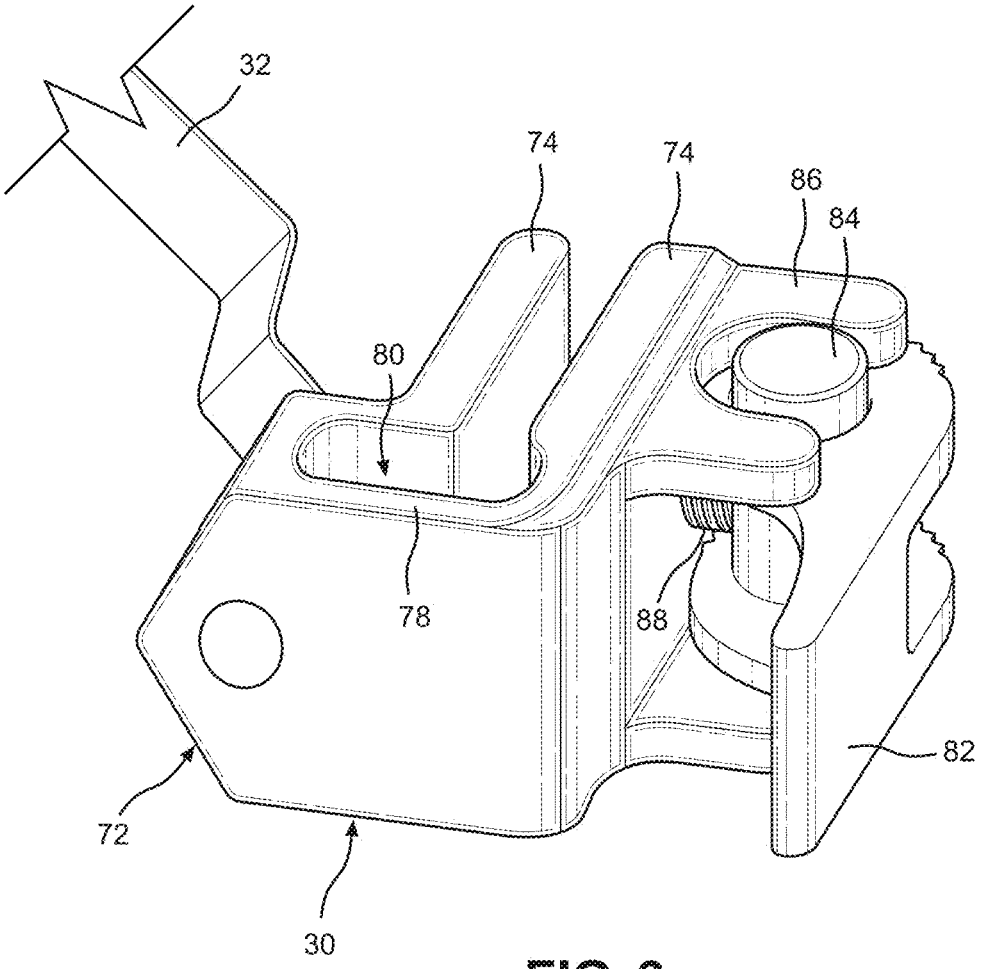

Referring to FIGS. 8 and 9, one of the pivot couplers 30 is shown connected to a leg 24*a* of the first frame 24. The opposite side of the canopy 10 includes a corresponding pivot coupler that is substantially identical in structure and function. Each pivot coupler 30 provides a sliding and clamping connection between the first frame 24 and the corresponding strut 32, permitting the canopy 10 to be smoothly adjusted and locked in a desired position.

The pivot coupler 30 includes a body 72 having a pair of opposed leg portions 74 and 76 joined at one end by an integral bridge or cross member 78 to form a single-piece structure. The body 72 defines a passage 80 through which the leg 24*a* of the first frame 24 extends, the passage 80 being located at the cross member 78, which provides a wall of the passage. The opposed leg portions 74 and 76 are spaced slightly apart and are configured to flex toward one another to clamp around the leg 24*a* when tightened.

A cam toggle lever 82 is mounted to the body 72 by a pintle 84, the opposite ends of which are supported in saddles 86 formed in the body 72. A bolt 88 extends transversely through the body 72 and across the opposed leg portions 74 and 76 and is threaded into the pintle 84. When the toggle lever 82 is rotated to a locked position, the cam action draws the pintle 84 toward the bolt 88, squeezing the leg portions 74 and 76 together and tightening the body 72 around the leg 24*a* of the first frame 24. When the toggle lever 82 is rotated to an unlocked position, the leg portions 74 and 76 are released, allowing the coupler 30 to slide freely along the leg 24*a* for adjustment.

The toggle lever 82 includes serrations or teeth 90 that are engageable with corresponding serrations or teeth 92 formed on the body 72 to retain the lever in its locked position during use. The toggle lever 82 is configured to be operated easily by a user's thumb or fingers without tools. The end of the corresponding strut 32 is pivotally attached to the body 72 on the side opposite the toggle lever 82, enabling the strut 32 to pivot freely relative to the coupler 30 as the canopy 10 is raised or lowered.

This construction provides a secure, tool-less interface that permits both sliding and locking movement of the pivot coupler 30 along the first frame 24 while maintaining a stable pivot connection to the strut 32. The arrangement allows precise, synchronized adjustment of the canopy 10 while preserving structural rigidity and ease of operation.

Figure 10:
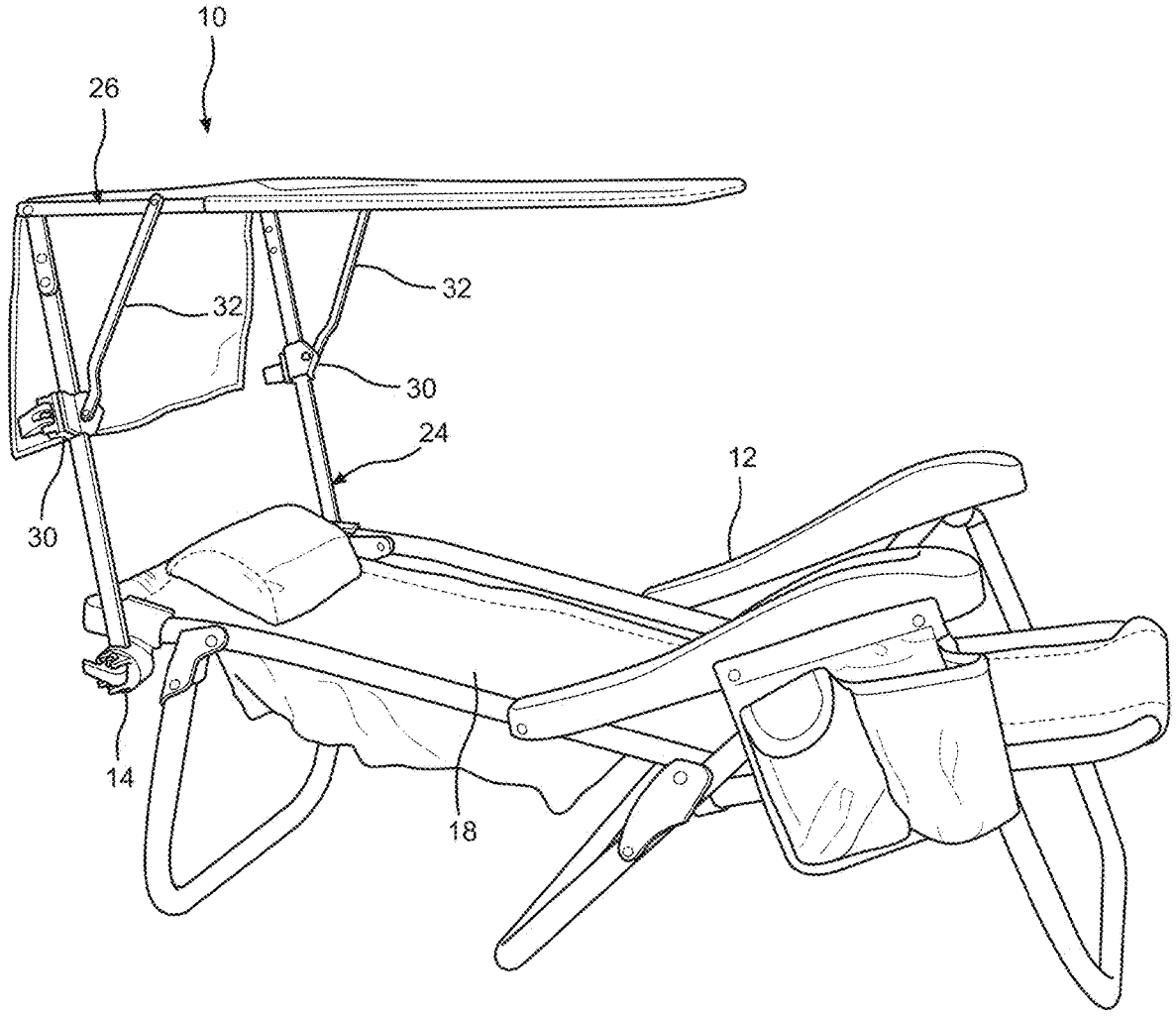
FIG. 10 is a perspective view of the canopy attached to the chair, with the chair shown in a reclined position and the canopy oriented to provide shade for the user.

Referring to FIG. 10, the canopy 10 is shown attached to the chair 12 with the chair positioned in a reclined configuration. In this view, the canopy 10 is oriented to provide effective shade coverage for a person seated in the reclined chair. The adjustable connection provided by the clamp assemblies 14 and pivot couplers 30 allows the canopy 10 to be repositioned as the chair back 18 reclines, maintaining an optimal shading orientation relative to the user.

As illustrated, the first frame 24 and second frame 26 cooperate with the struts 32 and pivot couplers 30 to maintain the canopy panel 28 above the chair back 18, with the angle of the canopy 10 adjusted to compensate for the change in geometry caused by reclining. The combined adjustability of the clamp assemblies 14, which allow rotation of the canopy 10 relative to the chair 12, and the pivot couplers 30, which permit angular adjustment of the second frame 26 relative to the first frame 24, enables the canopy 10 to remain functional and properly aligned in all recline positions of the chair.

This configuration demonstrates the canopy's ability to adapt to different chair orientations while maintaining continuous shade coverage and user comfort without requiring detachment or reassembly.

Figure 11:
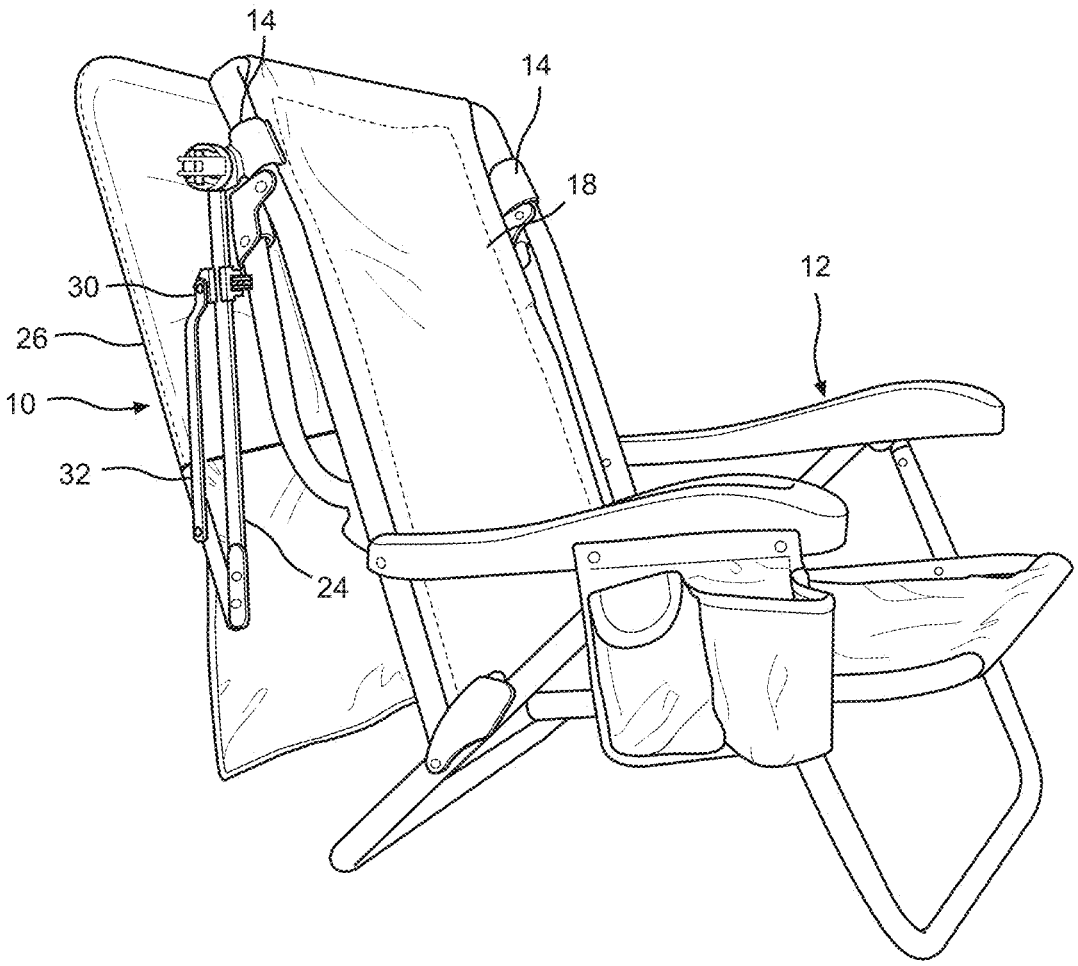
FIG. 11 is a perspective view of the canopy attached to the chair in a stowed position located behind the chair back.

Referring to FIG. 11, the canopy 10 is shown attached to the chair 12 in a stowed or collapsed position located generally behind the chair back 18. In this configuration, the canopy 10 remains connected to the chair 12 by the clamp assemblies 14 but is rotated and folded into a compact arrangement for storage or transport. The first frame 24 and second frame 26, together with the pivot couplers 30 and struts 32, cooperate to allow the canopy panel 28 to fold rearwardly behind the chair back 18 without requiring removal of the canopy 10 from the chair 12.

This stowed position reduces the overall profile of the chair and prevents interference when the chair is folded or carried. When the chair 12 is of a backpack-style design, the stowed position of the canopy 10 allows the chair and canopy to be carried together as a single integrated unit, enhancing portability and convenience for the user. The canopy 10 can be quickly transitioned from the stowed position to an operative shading position by releasing the locking hubs 38 and pivot couplers 30, rotating the canopy 10 into the desired orientation, and re-engaging the locks. The ability to store the canopy 10 in this manner allows the chair 12 to be used and transported in the same manner as a conventional folding or backpack chair, while retaining the convenience of an integrated shading system that can be deployed instantly when needed.

The structural arrangement of the clamp assemblies and pivot couplers provides several functional benefits when the canopy is used in connection with folding or reclining chairs. The dual-axis adjustment, achieved through rotation of the first frame at the clamp assemblies and angular repositioning of the second frame via the pivot couplers, allows the canopy to be repositioned with minimal user movement. Because each adjustment joint provides friction-based resistance rather than discrete indexed positions, the user may adjust the canopy with one hand while remaining seated or in a reclined posture. This arrangement avoids the need for the user to stand, reach behind the chair, or reposition the chair itself in order to obtain additional shading.

The friction-based nature of both adjustment mechanisms further allows the canopy to be moved through a continuous range of positions without reliance on ratchet plates, detents, or other indexed or snap-through components. As a result, the canopy angle can be fine-tuned throughout the day to accommodate shifting sunlight conditions, reduce overhead glare, or optimize shading when reading or relaxing.

The combined rotational and angular adjustability also enables shading coverage when the chair is placed in a substantially reclined or lie-flat configuration. In such positions, the canopy can be oriented close to the user's upper body or face, providing effective overhead shading where conventional fixed-position or ratcheting canopy structures cannot be lowered sufficiently to block direct sunlight.

Additionally, the use of enclosed friction joints eliminates many of the pinch-point hazards typically associated with exposed hinge plates or ratcheting adjustment mechanisms. The pivot couplers rely on internal friction elements enclosed within the coupler body, reducing the potential for accidental finger entrapment during canopy adjustment and improving overall user safety.

While the invention has been described with reference to certain exemplary embodiments illustrated in the drawings and described above, it will be understood that various changes in form and detail may be made without departing from the spirit and scope of the invention. The features, materials, and arrangements described herein may be substituted, combined, or modified as would be apparent to those skilled in the art to achieve the same or similar results. The invention is therefore not limited to the specific embodiments described but is defined by the appended claims and their equivalents.

The invention claimed is:

1. A chair canopy that is removably attachable to a chair back of a chair, the chair canopy comprising:

a frame assembly including a chair-attachable frame and a canopy frame, the canopy frame hingedly connected to the chair-attachable frame such that the canopy frame is rotatable with respect to the chair-attachable frame;

the chair-attachable frame having first and second leg members connected by a first cross member at corresponding first ends of the first and second leg members;

the canopy frame having first and second leg members connected by a second cross member;

a canopy panel attached to and supported by the canopy frame;

a first pivot coupler slidably coupled to the first leg of the chair-attachable frame for movement along a length thereof, the first pivot coupler being selectively securable to the first leg to lock its position along the length;

a second pivot coupler slidably coupled to the second leg of the chair-attachable frame for movement along a length thereof, the second pivot coupler being selectively securable to the second leg to lock its position along the length;

a first strut extending between the first leg of the canopy frame and the first pivot coupler and being pivotally connected at one end to the first leg of the canopy frame and pivotally connected at an opposite end to the first pivot coupler;

a second strut extending between the second leg of the canopy frame and the second pivot coupler and being pivotally connected at one end to the second leg of the canopy frame and pivotally connected at an opposite end to the second pivot coupler;

first and second clamp assemblies, each comprising:

a locking hub including first and second hub halves rotatably coupled for 360-degree rotation about a rotational axis, interior surfaces of the hub halves being in frictional engagement;

a cam toggle lever rotatably supported on an exterior of the second hub half by a pintle;

a bolt extending through aligned openings in the hub halves and threaded into the pintle to couple the hub halves;

the cam toggle lever having a first plurality of serrations on a curved exterior surface thereof, the second hub half having a second plurality of serrations thereon, the first and second pluralities of serrations being engageable to retain the cam toggle lever in a clamped position;

a spring disposed on the bolt and configured to bias the hub halves into engagement; and a resilient clamp body coupled to the first hub half and defining an open channel configured to flex to engage and disengage a chair-back post of the chair without tools; and a second end of the first leg of the chair-attachable frame connected to the second hub half of the first clamp assembly, and a second end of the second leg of the chair-attachable frame connected to the second hub half of the second clamp assembly.

2. The chair canopy of claim 1, wherein the resilient clamp body is configured to disengage from the post when subjected to an excessive upward or lateral force to prevent damage to the canopy or the chair.

3. The chair canopy of claim 1, wherein the interior surfaces of the first and second hub halves have intermeshing surface formations arranged circumferentially around a central cylindrical interface to maintain alignment and evenly distribute load.

4. The chair canopy of claim 1, wherein the canopy is rotatable relative to the chair back through a continuous range of motion, including forward, upward, and rearward orientations.

5. The chair canopy of claim 1, wherein the canopy is foldable into a compact stowed position located behind the chair back while remaining attached to the chair.

6. The chair canopy of claim 5, wherein the chair is a backpack-style folding chair and the stowed position allows the chair and canopy to be carried together as a single integrated unit.

7. The chair canopy of claim 1, wherein the first and second clamp assemblies and the first and second pivot couplers are each configured to provide variable frictional resistance between freely rotating and fully locked positions.

8. The chair canopy of claim 1, wherein the chair-attachable frame and canopy frame are each formed of rigid, non-telescoping tubular members.

9. The chair canopy of claim 1, wherein the canopy panel is formed of a flexible fabric or mesh material stretched across the second frame to provide shade for a seated user.

10. The chair canopy of claim 1, wherein adjustment of the first and second clamp assemblies and the first and second pivot couplers together allows the canopy to maintain a shading position across multiple reclining angles of a chair back to which the canopy is attached.

11. The chair canopy of claim 1, wherein the first hub half has a sidewall that encircles the interior surface thereof, the second hub half has a shoulder that encircles the interior surface thereof, and the sidewall encircles the shoulder to minimize ingress of sand or debris and to maintain smooth rotation during outdoor use.

12. The chair canopy of claim 11, wherein the interior surfaces of the first and second hub halves have intermeshing surface formations arranged circumferentially around a central cylindrical interface to maintain alignment and evenly distribute load, and wherein the surface formations on the first hub are axially recessed from an open end of the sidewall.

13. The chair canopy of claim 1, wherein each of the first and second pivot couplers have a body including a pair of opposed leg portions joined at one end by a cross member to define a unitary structure, the body defining a passage at the cross member configured to slidingly receive a respective first or second leg of the canopy frame, the opposed leg portions being spaced apart and resiliently deflectable toward one another to clamp the respective first or second leg of the canopy frame;

a cam toggle lever;

a pintle supporting the cam toggle lever, the pintle having opposite ends received in saddles formed in the body;

a bolt extending transversely through the body and across the opposed leg portions and threaded into the pintle; and wherein rotation of the cam toggle lever to a locked position draws the pintle toward the bolt to deflect the leg portions toward one another and clamp the respective first or second legs of the canopy frame within the passage, and rotation of the cam toggle lever to an unlocked position permits the leg portions to separate and the body to slide along the respective first or second legs of the canopy frame.

* * * * *